US011052682B2

(12) United States Patent
Roses Conesa et al.

(10) Patent No.: US 11,052,682 B2
(45) Date of Patent: Jul. 6, 2021

(54) IDENTIFYING PRINTING SUBSTRATE TYPES

(71) Applicant: HEWLETT-PACKARD DEVELOPMENT COMPANY, L.P., Spring, TX (US)

(72) Inventors: Francisco Javier Roses Conesa, Sant Cugat del Valles (ES); Jorge Solanas Lerida, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 287 days.

(21) Appl. No.: 16/339,105

(22) PCT Filed: Feb. 3, 2017

(86) PCT No.: PCT/US2017/016342

§ 371 (c)(1),
(2) Date: Apr. 3, 2019

(87) PCT Pub. No.: WO2018/143998

PCT Pub. Date: Aug. 9, 2018

(65) Prior Publication Data

US 2019/0224994 A1 Jul. 25, 2019

(51) Int. Cl.

| | |
|---|---|
| ***B41J 11/70*** | (2006.01) |
| ***B41F 33/02*** | (2006.01) |
| ***B41L 39/02*** | (2006.01) |
| ***B41L 47/56*** | (2006.01) |
| ***B41F 13/60*** | (2006.01) |

(Continued)

(52) U.S. Cl.

CPC ..... *B41J 11/706* (2013.01); *B26D 1/185* (2013.01); *B26D 5/00* (2013.01); *B41F 13/60* (2013.01); *B41F 33/02* (2013.01); *B41J 11/009* (2013.01); *B41J 11/70* (2013.01); *B41L 21/00* (2013.01);

(Continued)

(58) Field of Classification Search

CPC ..... B41L 21/00; B41L 21/12; B41L 39/02; B41L 47/56; B41J 11/706; B41J 11/009; B41J 11/70; B41F 13/60; B41F 33/02; B26D 1/185; B26D 5/00

See application file for complete search history.

(56) References Cited

U.S. PATENT DOCUMENTS

| | | | |
|---|---|---|---|
| 4,782,365 | A | 11/1988 | Takagi |
| 6,210,052 | B1 | 4/2001 | Smith |

(Continued)

FOREIGN PATENT DOCUMENTS

| | | | |
|---|---|---|---|
| CN | 203974256 | U | 12/2014 |
| WO | WO-2004059296 | A2 | 7/2004 |

OTHER PUBLICATIONS

"HP Color LaserJet 4700 Series Printer-Automatic Media Type Sensing"; May 2005.

*Primary Examiner* — David H Banh

(74) *Attorney, Agent, or Firm* — HP Inc. Patent Department

(57) ABSTRACT

Devices and methods for identifying categories or types of print media in image forming apparatuses are disclosed. In an example method print media are advanced in a feeding direction to reach a cutting position, a cutter is advanced in a cutting direction, perpendicular to the feeding direction to cut the print media, friction between the cutter and the print medium is measured, and the print media are identified based on the measured friction.

15 Claims, 6 Drawing Sheets

(51) Int. Cl.

| | |
|---|---|
| ***B41J 11/00*** | (2006.01) |
| ***B26D 1/18*** | (2006.01) |
| ***B41L 21/00*** | (2006.01) |
| ***B26D 5/00*** | (2006.01) |
| ***B41L 21/12*** | (2006.01) |

(52) U.S. Cl.
CPC ..... *B41L 21/12* (2013.01); *B41L 39/02* (2013.01); *B41L 47/56* (2013.01)

(56) References Cited

U.S. PATENT DOCUMENTS

| | | | | |
|---|---|---|---|---|
| 6,663,211 | B2 | 12/2003 | Aratsu | |
| 8,238,771 | B2 | 8/2012 | Murakami | |
| 2001/0026293 | A1* | 10/2001 | Kaneko | B41J 13/0054 347/14 |
| 2006/0022400 | A1* | 2/2006 | Kawasaki | G01N 33/346 271/227 |
| 2006/0086220 | A1* | 4/2006 | Kaneko | B26D 7/025 83/356.2 |
| 2007/0001389 | A1* | 1/2007 | Goetz | B65H 7/12 271/265.04 |
| 2007/0152396 | A1* | 7/2007 | Tanahashi | B65H 7/02 271/109 |
| 2007/0170293 | A1* | 7/2007 | Colombo | B65B 69/0033 242/319 |
| 2010/0079553 | A1 | 4/2010 | Katoh | |
| 2010/0217719 | A1* | 8/2010 | Olsen | G06F 21/00 705/318 |
| 2016/0206480 | A1* | 7/2016 | Wada | A61F 13/15617 |
| 2017/0267010 | A1* | 9/2017 | Takada | B41M 5/5245 |

* cited by examiner

IDENTIFYING PRINTING SUBSTRATE TYPES

BACKGROUND

Image forming apparatuses form images on media. Image forming apparatuses may be supplied with a variety of media including media in a form of a media supply roll. The roll media may be transported along a media transport path to a print zone to be printed thereon. The roll media may be cut by a cutter and output to a storage bin.

BRIEF DESCRIPTION

Some non-limiting examples of the present disclosure are described in the following with reference to the appended drawings, in which:

FIG. 1 schematically illustrates a device for identifying print media category or type according to an example.

FIG. 2 is a flow chart of an example method of identifying category or type of a print medium.

FIG. 3A to FIG. 3D schematically illustrate a device to perform print medium category or type identification according to an example.

DETAILED DESCRIPTION

Figure 1:
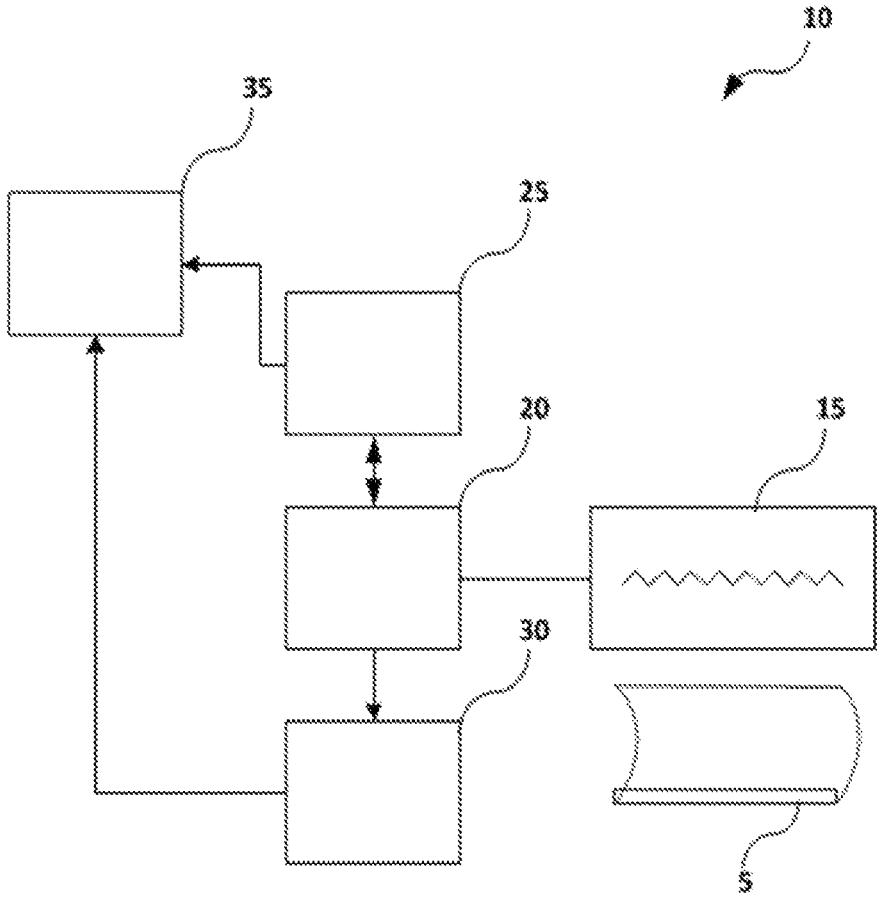

An image forming apparatus, e.g. a printer, using a print substrate in the form of a media supply roll, also known as continuous roll or web roll, may use cutters before and after printing. Before printing a cleaning cut may be performed using a cutter to clear any irregular shape or impurity on the leading edge of the print substrate.

Knowing the category or type of the printing substrate (e.g. paper) in the printer allows for selecting the proper settings that may be adapted based on the type or family of printing substrate material to be used. Such settings may include, among others, the amount of printing fluid, e.g. ink, to drop, mechanical adjustment to properly move the printing substrate through the printing path, color corrections to be applied or information about whether the printing substrate is to be dried or not after printing, etc. If these customizations are not done properly for each print substrate category, resulting image quality may be affected.

Some printers use width identification to select settings. The printer automatically identifies the width of the print substrate or medium and selects or applies settings based on the identified width. However, width identification may not identify print substrate type, as print substrates of the same width may be of a different type. For example, print substrates of different thickness may be provided or sold having the same width yet using different printer settings to account for the different thickness.

Other printers are based on user interaction. When a new printing substrate material is loaded, users are requested to specify paper category and/or type during the loading process. However, some users may not properly select the print substrate or may not be familiar with the various printing substrate types. Sometimes the printer may comprise a set of categories where the user is to select from the pre-established categories. However, printing substrate material purchased by the user may not match the name of any of the listed categories. Thus users may erroneously select a different substrate type than the one actually loaded in the printer.

In an image forming apparatus that uses a cutter, identifying a printing substrate category may be performed by measuring friction or changes in friction and/or friction levels when the cutter is in contact with the print medium, i.e. when the cutter performs a cutting operation. The friction level changes when the cutter comes in contact with the printing medium and is maintained during the clean cutting. Thus there is a measurable difference between average friction when the cutter is in operation but not performing a cutting operation and average friction when the cutter is performing a cutting operation.

This change may be registered as a signal change, e.g. a pulse-width-modulation (PWM) or voltage signal change. As different printing media may demonstrate different friction changes it is possible to identify the category or type of the substrate, accordingly. As settings between printing substrate materials of the same category may not differ substantially and may most of the times be the same, identifying the print medium substrate may allow for appropriate selection of printing settings. Thus the image quality defects that a wrong media category or type selection could cause may be reduced substantially.

Friction between the cutter and the print medium may be defined as the force exerted to maintain the cutter's velocity when traveling along the cutting dimension (either without cutting or during cutting the print medium). The cutter's velocity may be measured using an encoder. The position of the cutter (or cutter disc) may be sampled and registered using the encoder and the velocity may be measured by associating the position of the cutter along the cutting direction with the distance that the cutter has travelled along the cutting dimension. A drop in velocity, indicative of the presence of an obstacle (i.e. the print medium), may trigger an increase in the force that the cutter is to exert to the paper and this force increase may correspond to a positive friction change. Accordingly, an increase in velocity, indicative of the absence of an obstacle, may trigger a decrease in the force that the cutter is to exert to the paper and this force decrease may correspond to a negative friction change. By measuring the average friction when no obstacle is present and during the presence of the obstacle, two average friction values may be generated. The (absolute) difference between the two values may be associated with the print medium category or type. Therefore the print medium type may be determined by measuring the force exerted to maintain the cutter's velocity.

Measuring friction levels may comprise identifying friction changes when the cutter contacts a print medium's border. This may be performed by a controller measuring the cutter's actuator, e.g. motor, speed. In some cases the cutter may be in contact with a guide when no print medium is present. Thus a friction level may always be registered when the cutter is in operation or moving. By measuring a friction change, any friction level present in the absence of a print medium may not influence the friction change measurement results. Some actuators, e.g. DC or servo motors, may be driven by controllers using pulse-width-modulation (PWM) signals. In such cases the friction change may be registered as a change in the width of the pulse of the PWM signal or as a change in the voltage level used to power the motor. The change, i.e. the moment a change is identified, may be associated with the position of the cutter at the same moment in time.

FIG. 1 schematically illustrates a device for identifying print medium category or type according to an example. The print medium may be provided in a print zone. The device 10 may comprise a cutter 15 and an actuator 20 for the cutter. The cutter may cut a print medium 5 along a cutting dimension. The actuator 20 may advance the cutter 15 along the cutting dimension. Furthermore, the device 10 may comprise an encoder 30, coupled to the actuator. The device may further comprise a controller 25, connected to the actuator, to control the actuator 20, to register the position of the cutter 15 along the cutting dimension and to measure friction changes as a result of the cutter 15 finding resistance from the print medium when cutting is performed. The device may also comprise a processor 35 to receive the measured friction changes and the position of the cutter 35 from the controller 25. Based on the received data, the processor may: (i) identify a first friction value when the cutter is advancing without cutting, (ii) identify a second friction value when the cutter is advancing during cutting the print medium and (iii) calculate a difference in friction value as a function of the identified first and second friction values. It may then identify the print medium 5 based on the calculated difference in friction value. More specifically, during a first period the device may measure a low friction level while the cutter is not in contact with the paper. When a sudden drop in speed or change in friction is identified, the controller may begin measuring a second higher friction level indicative of the cutter being in contact (i.e. cutting) the print medium. When a sudden increase in speed or change in friction is identified, indicative now of the cutter not being in contact again with the print medium, the controller may revert to measuring again the low friction level. By averaging the measured low friction level values it may calculate a first friction value. By averaging the measured higher friction level values it may calculate a second friction value. Then by subtracting the two values it may calculate a difference in average friction levels. This difference may be associated with a print medium category or type. Therefore, it may identify the print medium category by calculating the difference in average friction levels. In some examples, the average friction when the cutter is not in contact with the print medium may be negligible. That is, the cutter may generate friction values below a predetermined measurable level. In such cases, the average friction while cutting the print medium may be used alone to identify the print medium. That is, any friction values when the cutter is not in contact with the print medium may not affect the result of the average friction difference calculation and subsequent print medium identification and may thus not be taken into consideration.

Figure 2:
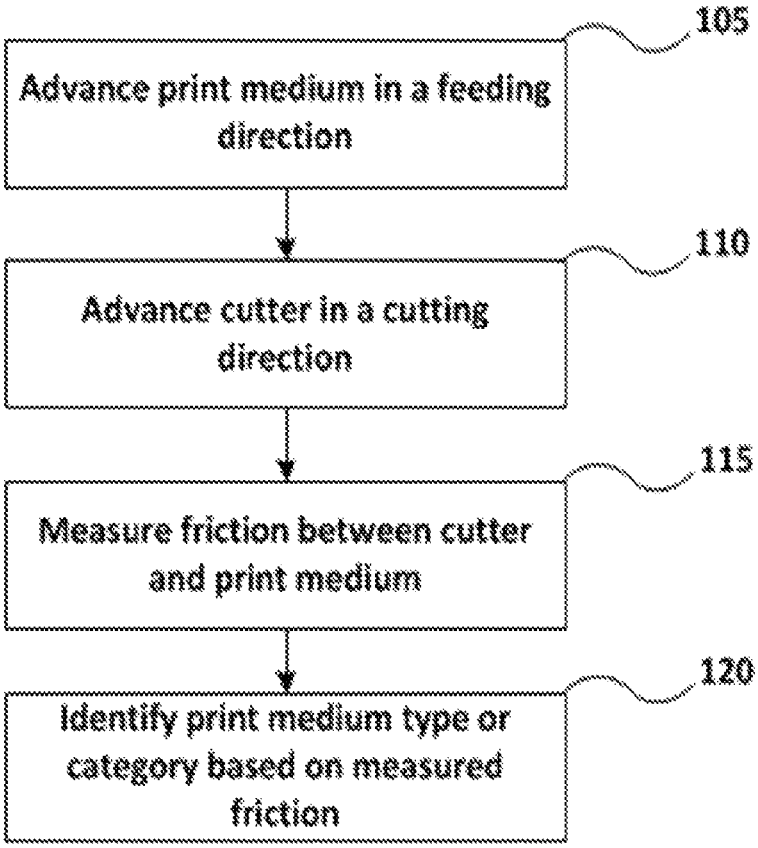

FIG. 2 is a flow chart of a method of identifying a border position of a print medium in a printer. The print medium may be in the form of a media supply roll or a media supply roll. In block 105 the print medium may be advanced in a feeding direction to reach a cutting position. The feeding direction may be the direction that the print medium advances to reach a print zone. The cutting position may be a position before the print medium enters the print zone where a part of the print medium is to be removed (i.e. cut) by a cutter. In block 110 the cutter may be advanced in a cutting direction to cut the print medium. The cutting direction may be perpendicular to the feeding direction. In block 115, friction between the cutter and the print medium may be measured. In block 120, the print medium may be identified based on the measured friction. Measuring friction may comprise identifying a first friction value when the cutter is advancing without cutting and a second friction value when the cutter is advancing during cutting the print medium. At the moment the cutter contacts the print medium, i.e. at the border of the print medium, the cutter may experience a momentary drop at its speed due to the change in friction. This speed drop allows for identifying a moment where the second friction value is to be measured. A difference in friction value as a function of the identified first and second friction values may be calculated. The first friction value, i.e. the friction value when there is no contact between the cutter and the print medium, may be perceived as a constant and may be either measured each time or it may be measured one time and thereafter stored in a memory for future use. Thus, identifying the first friction value may comprise retrieving the first friction value from the memory. This retrieval from memory may take place before advancing the cutter and when an initialization may take place. The initialisation may be performed when the imaging device is powered on or before a printing or cutting operation. In some cases the first friction value when there is no contact between the cutter and the print medium may be negligible and may not be used. Thus, measuring friction may comprise measuring the second friction value between the cutter and the print medium.

FIG. 3A to FIG. 3D schematically illustrate a device to identify a category of a print medium in an image forming apparatus according to an example. Image transfer device 200 may comprise a feeder 203 to feed print medium 201 into a print zone. The device 200 may further comprise a cutter 205. The cutter may be placed before the print zone. The print medium 201 may be in the form of a media supply roll. The feeder 203 may engage with the media supply roll 201 and advance the print medium in a feeding direction F and through cutter 205. The cutter 205 may comprise a guide 210, a cutting disc 215, a disc housing 220, a pulley 225 and a motor 207. The guide 210 may be in the form of a horizontal bar. The cutting disc 215 may be rolling along the guide. The disc housing 220 may partially house the cutting disc 215. The pulley 225 may be coupled to the motor 207. A cable 230 may be coupled to the disc housing 220 and to the pulley 225. When the motor 207 is powered, the pulley 225 may rotate and, with it, the cable 230 that carries the disc housing 220 and the cutting disc 215 may move along a cutting direction C, perpendicular to the feeding direction. The device may further comprise a controller 235 to control the motor 207. The motor 207 may be a servomotor and the controller 235 may be a proportional-integral-derivative (PID) controller using pulse-width modulation. Furthermore, the device 200 may comprise an encoder 240. The encoder 240 may be coupled to the motor 207. The encoder 240 may register motor position or rotation associated with the position of the cutting disc 215 along the cutting direction.

Figure 3A:
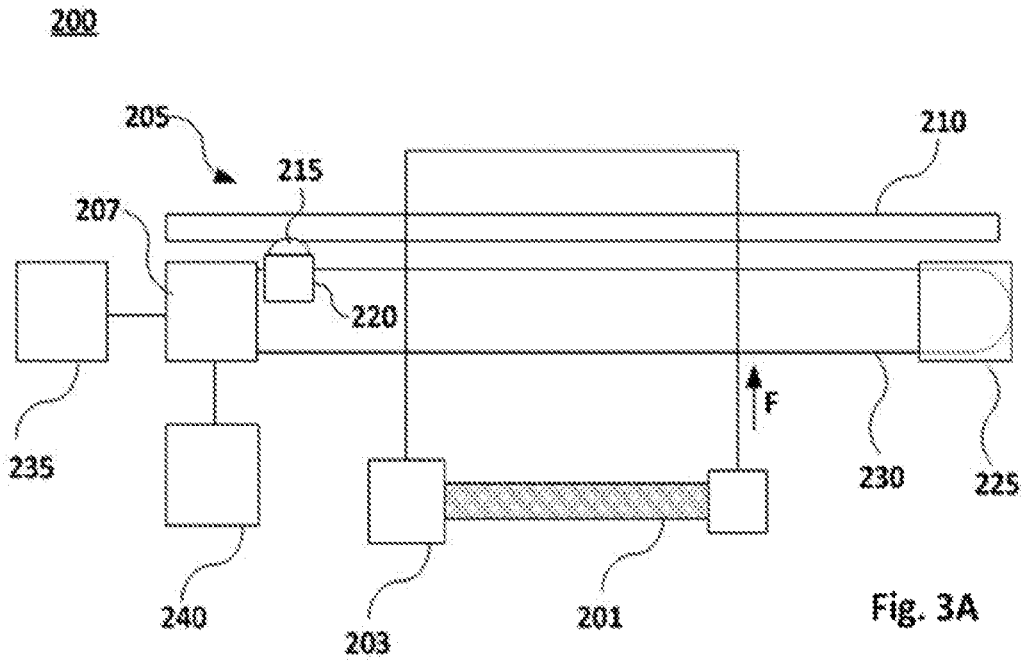

In FIG. 3A the cutting disc 215 is illustrated in a resting position. The feeder 203 may rotate the media supply roll 201 so that print medium may be inserted in the print zone. The print medium may be guided by guide 210. The feeder 203 may provide a predetermined quantity or length of print medium to the print zone. Then the feeder 203 may stop. The feeder stopping may trigger the controller 235 of the motor 207. In FIG. 3A the cutter 205 may be activated. The motor 207 may be powered by controller 235 and the cable 230 may start moving and, alongside, disc housing 220 and cutting disc 215. As the cutting disc advances it may initially roll along the guide 210 in an area of the guide where no print medium may be present. This rolling may generate first friction values within a first friction range that may be sampled by controller 235. The controller 235 may measure the friction values and while the friction values remain within the first friction range they may contribute to a first average friction value. The first average friction value may correspond to the friction level when no print medium is present. At the same time, the controller may sample the encoder 240 signals that correspond to the position of the cutting disc. The encoder 240 may have associated the rotational angle of the motor 207 with the position of the cutting disc 215. For example, if the motor makes ten rotations to advance the cutting disc from one side of the guide to the other side, then, for each degree of the motor's rotation the cutting disc, the cutting disc will have travelled one 2/(360*10) distance along the guide. For example, for a cutting distance of one meter (1 m), this may allow the determination of the cutters position with sub-millimetre precision. The velocity of the cutter 205 may be measured by associating the position of the cutter 205 along the cutting direction with the distance that the cutter 205 has travelled along the cutting dimension. By measuring the average friction when no obstacle (i.e. print medium) is present and during the presence of the obstacle, two average friction values may be generated. The (absolute) difference between the two values may be associated with the print medium category or type. Therefore the print medium type may be determined by measuring the force used to maintain the cutter's velocity.

Figure 3B:
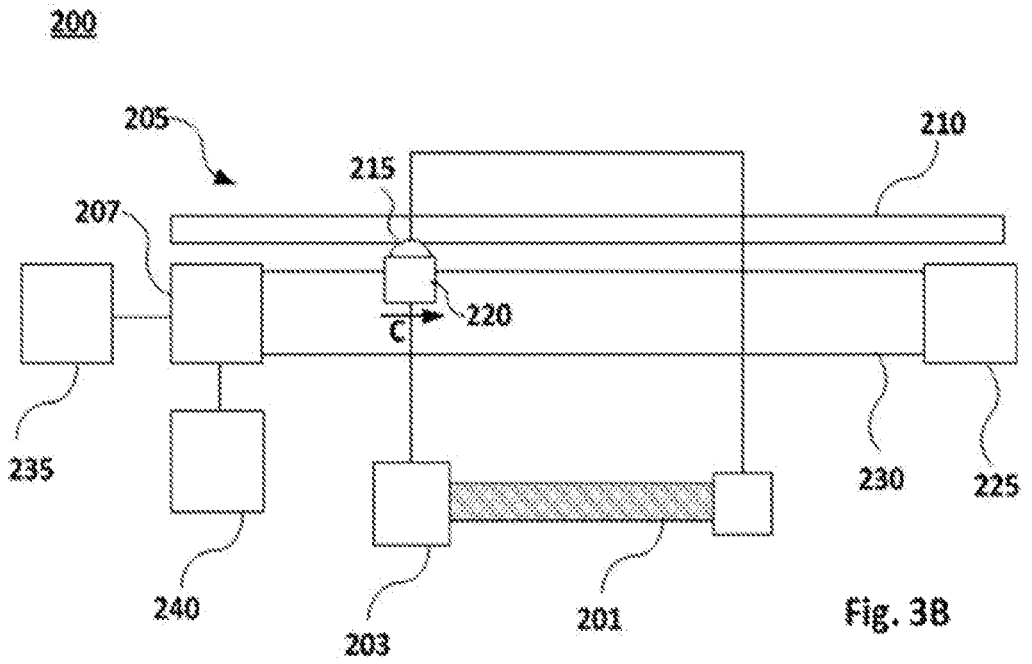

FIG. 3B illustrates the moment the cutting disc 215 makes contact with the print medium. Up until the moment of contact the friction between the cutting disc 215 and the guide 210 may be within the first friction range and the cutting disc 215 may have reached a relatively constant speed, e.g. a predetermined speed. However, at the moment in time when the cutting disc 215 contacts the print medium a sudden drop in the cutting disc's speed may be sensed by the controller 235. Then the controller 235 may increase the power (width of pulse PWM signal or amplitude of voltage) of the motor to maintain the speed. This moment may be identified as the moment the cutting disc 215 touches the border of the print medium 201. Then this moment may be associated with the position of the cutting disc as registered using the encoder 240. Knowing the moment of contact by the controller 235 and the position of the cutting disc by the encoder 240 allows determining the position of the border of the print medium along the cutting direction in the print zone. At this moment, the controller may stop associating the sampled friction values with the first average friction value and start associating the sampled friction values with a second average friction value.

Figure 3C:
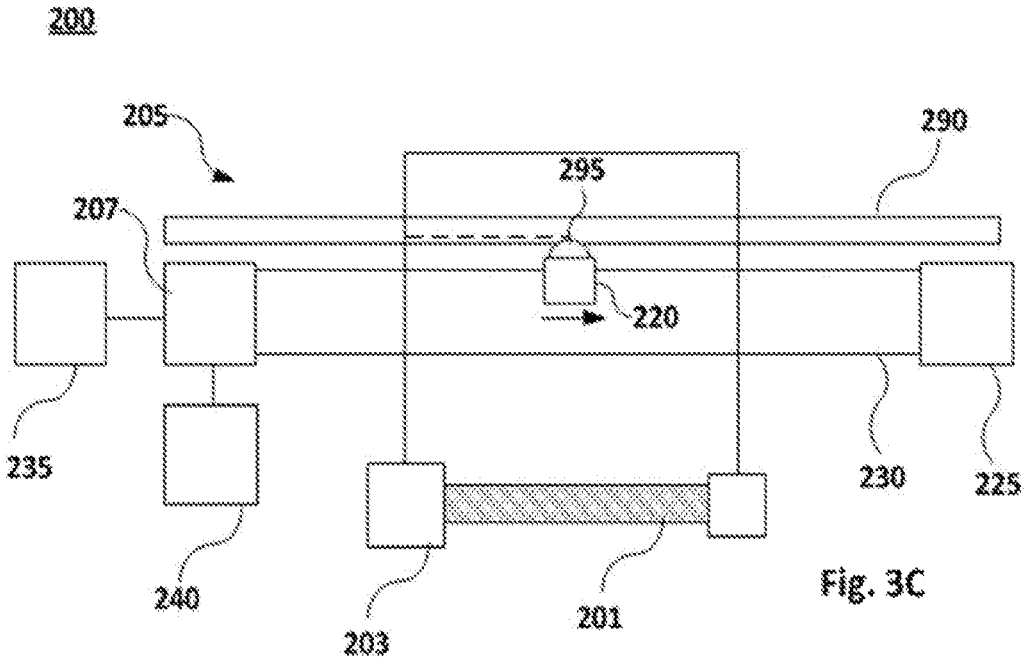

FIG. 3C shows the cutting disc cutting through the print medium. During the time it takes to traverse the print medium, the cutting disc 215 may have assumed again a constant speed, as the controller 235 may have increased the width of the PWM pulse or raised the voltage to counter the resistance of the print medium and the increased friction. Therefore, during the time it takes to cut through the print medium, no substantial changes in the cutter's speed may be recorded. The controller 235 may continue sampling the friction value and associate the sampled values with the second average friction value until the cutting of the print medium is finished. The difference between the two average friction values may then be used to identify the print medium type or category.

Figure 3D:
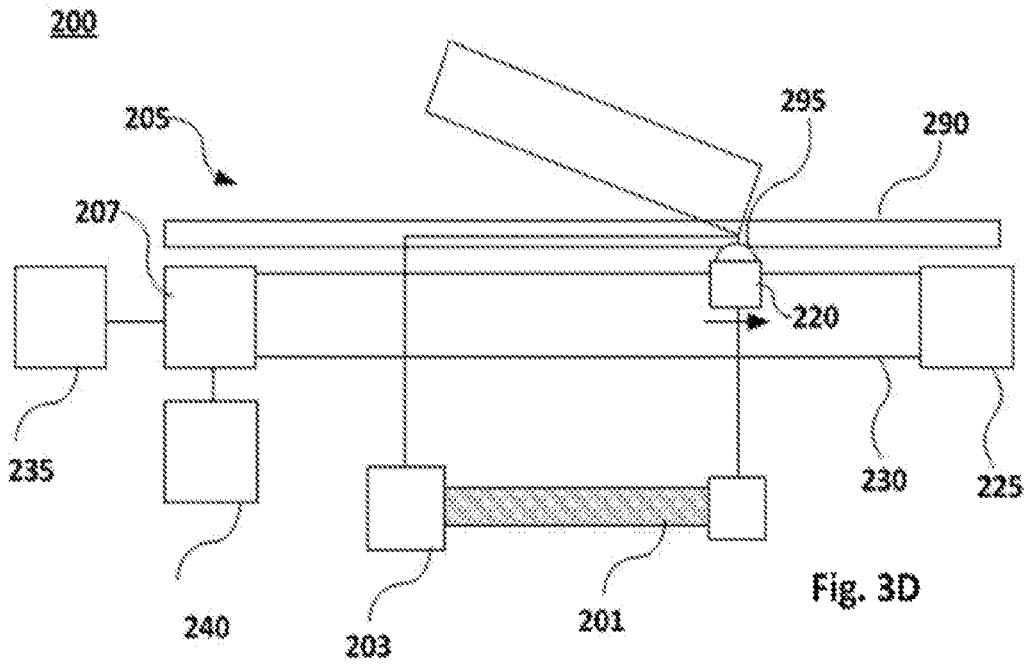

FIG. 3D shows the cutting disc 215 at the moment it finishes cutting and "exits" from the print medium. At that moment, a reverse situation may be sensed by the controller 235. As the friction may suddenly drop, due to absence of print medium, the velocity of the cutter disc may momentarily increase. The controller may perceive this increase in velocity and reduce the voltage or duration of the PWM pulse to return the cutter to the predetermined speed. This moment in time may be identified as the moment the cutting disc 215 leaves from the border of the print medium. Thus, again, this moment may be associated with the position of the cutting disc 215 as registered by the encoder 240. It may correspond to the position of the second border of the print medium. At this moment, the controller may stop associating the sampled friction values with the second average friction value. The controller may then continue associating the next sampled values with the first average sample value or determine the print medium category based on the first and second average friction values based on the sample friction values already received.

It is noted that the first average friction value may not be calculated every time a cutting operation or a print medium type determination is performed. The first average friction value may be substantially constant overtime. Therefore, it may be determined once and thereafter stored in a memory. Subsequently, it may be recalculated after a certain period of time or after a number of cutting operations is performed to account for wear of the cutter that may affect friction values.

The controller 235 may comprise a processor 237 coupled to a memory 239. The memory 239 may store motor control instructions that, when executed by the processor 239, control the motor to maintain a predetermined speed of the cutter. The controller 235 may be a motor controller, i.e. provided to control the motor of the cutter, or it may be part of a controller of the image transfer device, e.g. part of a printer's controller that may control various aspects of the printing process (e.g. print medium feeding, print medium cutting, delivery of print fluid to the print medium, etc.). Furthermore, in some implementations, the calculations with respect to the print medium category or type may be performed by the cutter controller based on data generated therewith. Then the cutter controller may communicate the results to the image transfer device's, e.g., printer's, controller. In other implementations, the calculations and/or the determination of the print medium category or type may be performed by the printer controller based on data received by the cutter controller. The cutter controller or the printer controller may comprise a table stored in a memory associating friction values or friction value differences with print media types or categories. Thus, when a friction value or a friction value difference is identified by the cutter controller, the same cutter controller or the printer controller may identify the print medium type or category by accessing the look-up table and identifying the print medium type or category associated therein with the identified friction value difference.

Figure 4:
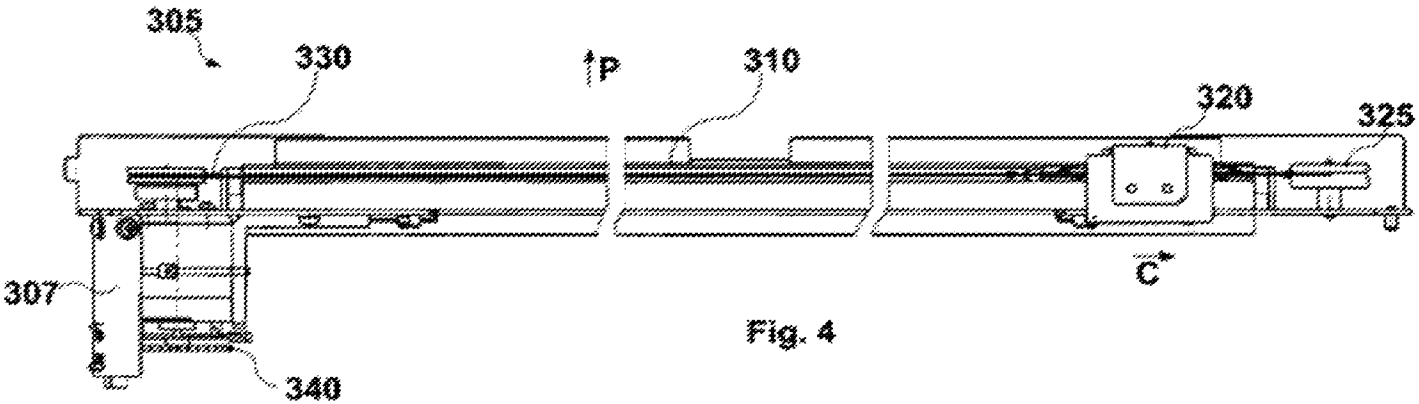
FIG. 4 is a line diagram schematically illustrating a cutter according to an example.

FIG. 4 is a line diagram schematically illustrating a cutter according to an example. Cutter 305 may comprise a guide 310, a disc housing 320 to house a cutting disc (not shown), a pulley 325 and a motor 307. The motor 307 may comprise or may be coupled to a controller. The guide 310 may be in the form of a horizontal bar. The cutting disc may be rolling along the guide. The disc housing 320 may partially house the cutting disc 215. The pulley 325 may be coupled to the motor 307. A cable 330 may be coupled to the disc housing 320 and to the pulley 325. When the motor 307 is powered, the pulley 225 may rotate and, with it, the cable 330 that carries the disc housing 320 (with the cutting disc) may move along a cutting direction C, perpendicular to a feeding direction P. The controller may measure speed of the motor 307 and friction values of the cutting disk as the cutting disk rotates along the direction C. Furthermore, the cutter 305 may comprise a rotary encoder 340. The rotary encoder 340 may be coupled to the motor 307. The encoder 340 may register motor rotation associated with the position of the cutting disc along the cutting direction. For example, the rotary encoder may comprise an optical sensor and markings, wherein the optical sensor may register a plurality of cutter positions for each rotation of the motor. Each marking may correspond to a cutter position along the cutting direction for each motor revolution. The cutter 305 may be used in an image forming apparatus (e.g. printer) that employs roll media.

Figure 5:
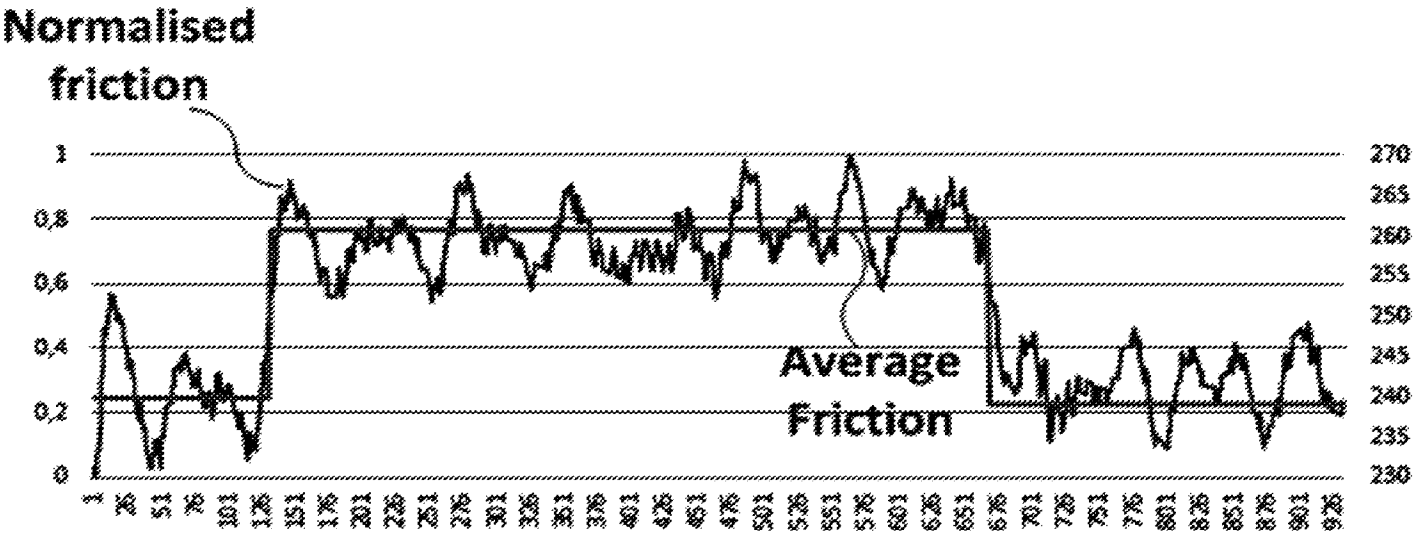
FIG. 5 is a chart schematically illustrating friction signals associated with sample iterations according to an example.

FIG. 5 is a chart schematically illustrating friction signals associated with sample iterations according to an example. The horizontal axis represents number of iterations. The left vertical axis represents force signals (filtered and normalized) applied to the cutter. The right vertical axis represents average force applied to cutter in each section (before cutting a print medium, during cutting and after cutting). The represented force changes may be derived by measuring changes in the PWM signal width or by measuring voltage level needed to maintain the cutter's speed. The cutter's speed may be derived by measuring the rotational speed of the cutter's motor or the linear speed of the cutter's disk. As may be observed in FIG. 5, there is a lower level of friction (oscillating around approximately 0.2 friction units) up to around sample 126. Then, suddenly, friction increases and begins oscillating around approximately 0.8 friction units. This may be attributed to the presence of a print medium. In the example of FIG. 5 the print medium is plain paper having a width of 620 mm. At the first print medium border where the jump in friction level takes place, a first friction value may be identified or calculated based on the samples received up to that point. Accordingly, at the second print medium border where a drop in friction level takes place, a second friction value may be identified or calculated based on the samples received between sample 126 and sample 651. In the example of FIG. 5 it may be observed that average friction (Fn) before the cutter comes in contact with the paper is 239.313 units, while the average friction (Fp) while cutting the paper is 260.818 units. So, the difference of average friction when there is plain printing substrate material (one of the softest materials) and when there is no substrate material may be calculated as 21.505 units. That is:

$$\text{Difference of friction} = Fp - Fn = 260.818 - 239.313 = 21.505 \text{ units}$$

Therefore, by checking how big the difference in average friction in and out of the printing surface material is, allows us to identify the media category. The printer controller may have a table associating friction differences with paper category or type. Thus by knowing the friction difference, the printer controller may determine the category or type of the print medium. The printer controller may then select settings based on the identified category or type of the print medium.

In another example, the average friction (Fn) when the cutter is not in contact with the print medium may be below a predetermined level. That is, the cutter may not be in contact with the guide of the cutter or the contact with the guide may generate friction values below the predetermined level. In such cases, the average friction (Fp) while cutting the print medium may be used alone to identify the print medium.

It will be appreciated that examples described herein may be realized in the form of hardware or a combination of hardware and software. Any such software may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disc or magnetic tape. It will be appreciated that the storage devices and storage media are examples of machine-readable storage that are suitable for storing a program or programs that, when executed, implement examples described herein. Accordingly, some examples provide a program comprising code for implementing a system or method as claimed in any preceding claim and a machine readable storage storing such a program. Still further, some examples may be conveyed electronically via any medium such as a communication signal carried over a wired or wireless connection.

All of the features disclosed in this specification (including any accompanying claims, abstract and drawings), and/or all of the operations of any method or process so disclosed, may be combined in any combination, except combinations where at least some of such features and/or operations are mutually exclusive.

Each feature disclosed in this specification (including any accompanying claims, abstract and drawings), may be replaced by alternative features serving the same, equivalent or similar purpose, unless expressly stated otherwise.

Although a number of particular implementations and examples have been disclosed herein, further variants and modifications of the disclosed devices and methods are possible. As such, representative examples of the present disclosure have utility over a wide range of applications, and the above discussion is not intended and should not be construed to be limiting, but is offered as an illustrative discussion of aspects of the disclosure. Many variations are possible within the spirit and scope of the disclosure, which is intended to be defined by the following claims—and their equivalents—in which all terms are meant in their broadest reasonable sense unless otherwise indicated.

The invention claimed is:

1. A method of identifying a category or type of a print medium in an image forming apparatus, the method comprising:

advancing the print medium in the image forming apparatus in a feeding direction to reach a cutting position;

advancing a cutter of the image forming apparatus in a cutting direction, perpendicular to the feeding direction to cut the print medium;

measuring friction between the cutter and the print medium; and identifying the category or type of the print medium based on the measured friction.

2. The method according to claim 1, wherein measuring friction comprises identifying a force to apply to the cutter for maintaining a predetermined velocity when the cutter is advancing.

3. The method according to claim 1, wherein measuring friction comprises:

identifying a first friction value when the cutter is advancing without cutting;

identifying a second friction value when the cutter is advancing during cutting the print medium; and calculating a difference in friction value as a function of the identified first and second friction values.

4. The method according to claim 3, wherein identifying a first friction value when the cutter is advancing without cutting comprises measuring friction between a cutting disc of the cutter and a guide of the cutter and calculating a first average friction value.

5. The method according to claim 3, wherein identifying a second friction value when the cutter is advancing during cutting the print medium comprises measuring friction between a cutting disc of the cutter and the print medium and calculating a second average friction value.

6. The method according to claim 3, further comprising identifying a change in friction value above a predetermined level, wherein before identifying the change in friction value the first friction value is identified whereas after identifying the change in friction value the second friction value is identified.

7. The method according to claim 6, wherein identifying a change in friction value above a predetermined level comprises identifying a change in the cutter's speed above a predetermined value.

8. The method according to claim 7, wherein the cutter is driven by a motor and wherein identifying a change in the cutter's speed comprises identifying a change in rotational speed of the motor driving the cutter.

9. The method according to claim 8, wherein the motor is driven by a pulse-width-modulation signal and wherein identifying a change in the rotational speed of the motor driving the cutter comprises identifying a change in the width of the pulse of the signal.

10. The method according to claim 8, wherein the motor is a DC motor and wherein identifying a change in the speed of the motor driving the cutter comprises identifying a change in the amplitude of the voltage powering the DC motor.

11. A device to identifying a category of a print medium, comprising:

a cutter, to cut the print medium along the cutting dimension;

an actuator, to advance the cutter along the cutting dimension;

an encoder, coupled to the actuator;

a controller, connected to the actuator, to register the position of the cutter along the cutting dimension and to measure friction changes as a result of the cutter finding resistance from the print medium when cutting; and a processor to receive measured friction changes;

identify respective cutter positions;

identify a first average friction value when the cutter is advancing without cutting;

identify a second average friction value when the cutter is advancing during cutting the print medium;

calculate a change in friction value as a function of the identified first and second friction values; and identify the print medium based on the calculated change in friction value.

12. The device according to claim 11, wherein the cutter comprises:

a guide;

a cutting disc, rolling along the guide;

a disc housing, to partially house the cutting disc;

a pulley, coupled to the actuator; and a cable, coupled to the disc housing and to the pulley, wherein the actuator is to rotate the pulley.

13. The device according to claim 11, wherein the actuator is a motor comprising an axis of rotation and the encoder comprises a rotary encoder.

14. The device according to claim 13, wherein the encoder comprises an optical sensor and markings, wherein the optical sensor is to register a plurality of cutter positions for each rotation of the motor, each marking corresponding to a cutter position along the cutting direction.

15. An image forming apparatus, comprising:

a feeder, to advance a print medium in a feeding direction;

a cutter, to cut the print medium in a cutting direction, perpendicular to the feeding direction;

a motor, connected to the cutter, to advance the cutter in the cutting direction;

an encoder, connected to the motor, to register positions of the cutter along the cutting direction in time; and a controller, coupled to the encoder, to:

detect changes in the motor's speed as the cutter advances in the cutting direction to cut the print medium; and identify the registered position at the encoder during the motor speed changes, wherein the printer is to identify a category of the print medium based on the detected changes in the motor speed and associated friction value changes when a change in the motor's speed is detected.

* * * * *